US008416141B2

(12) United States Patent
Kunze

(10) Patent No.: US 8,416,141 B2
(45) Date of Patent: Apr. 9, 2013

(54) DUAL POLARISED RADIATING ELEMENT FOR CELLULAR BASE STATION ANTENNAS

(75) Inventor: Marco Kunze, Hamburg (DE)

(73) Assignee: Alcatel Lucent, Paris (FR)

( * ) Notice: Subject to any disclaimer, the term of this patent is extended or adjusted under 35 U.S.C. 154(b) by 798 days.

(21) Appl. No.: 12/339,576

(22) Filed: Dec. 19, 2008

(65) Prior Publication Data

US 2009/0160730 A1 Jun. 25, 2009

(30) Foreign Application Priority Data

Dec. 21, 2007 (EP) ..... 07291582

(51) Int. Cl.
*H01Q 21/26* (2006.01)

(52) U.S. Cl.
USPC ..... 343/797; 343/835

(58) Field of Classification Search ..... 343/797, 343/834, 835, 836, 837, 908, 912, 799
See application file for complete search history.

(56) References Cited

U.S. PATENT DOCUMENTS

| | | | | |
|---|---|---|---|---|
| 5,181,044 | A | 1/1993 | Matsumoto et al. | |
| 5,861,854 | A | 1/1999 | Kawahata et al. | |
| 6,057,802 | A * | 5/2000 | Nealy et al. | 343/700 MS |
| 6,067,053 | A * | 5/2000 | Runyon et al. | 343/797 |
| 6,356,242 | B1 * | 3/2002 | Ploussios | 343/795 |
| 6,741,220 | B2 | 5/2004 | Inoue | |
| 7,075,485 | B2 | 7/2006 | Song et al. | |
| 2006/0109193 | A1 * | 5/2006 | Williams | 343/797 |
| 2006/0227052 | A1 | 10/2006 | Tavassoli Hozouri | |
| 2007/0210976 | A1 * | 9/2007 | Luk et al. | 343/793 |

FOREIGN PATENT DOCUMENTS

| | | | |
|---|---|---|---|
| CN | 1898885 | A | 1/2007 |
| DE | 100 35 820 | A1 | 1/2002 |
| JP | 36-012823 | | 5/1961 |
| JP | 8222946 | A | 8/1996 |
| JP | 10013139 | A | 1/1998 |
| JP | 2001257524 | A | 9/2001 |
| JP | 3116501 | | 12/2005 |
| JP | 2006352293 | A | 12/2006 |

OTHER PUBLICATIONS

S. Lindenmeier et al., "A Multifunctional Antenna for Terrestrial and Satellite Radio Applications," IEEE MTT-S International Microwave Symposium Digest, pp. 393-396, 2001.
Partial European Search Report.

* cited by examiner

*Primary Examiner* — Robert Karacsony
(74) *Attorney, Agent, or Firm* — Fay Sharpe LLP

(57) ABSTRACT

The invention relates to a dual polarized radiating element for a cellular base station antenna, comprising a reflector surface for reflecting radiation energy, four radiating monopoles distributed around an aperture area, each radiating monopole comprising a footing protruding from said reflector surface and a flange located above the reflector surface and protruding from said footing radially towards the outside, the flanges from adjacent monopoles extending radially perpendicular to each other. The element further comprises four element feeds, each capacitively coupled to a respective monopole and protruding radially therefrom within the aperture area, and powering means connected to the element feeds.

11 Claims, 2 Drawing Sheets

DUAL POLARISED RADIATING ELEMENT FOR CELLULAR BASE STATION ANTENNAS

CROSS-REFERENCE TO RELATED APPLICATIONS

This application is based on European Patent Application No. 07 291 582 filed on Dec. 21, 2007, the disclosure of which is hereby incorporated by reference thereto in its entirety, and the priority of which is hereby claimed under 35 U.S.C. §119.

BACKGROUND OF THE INVENTION

The present invention relates to a dual polarised radiating element for a cellular base station antenna. Recently, the demand for antennas for mobile and wireless applications has increased dramatically. There are now a number of land based systems for wireless communications using a wide range of frequency bands.

Several cellular base station antenna manufacturers are proposing antennas having electrical dipoles located one quarter of a wavelength above a finite ground plane formed by a reflector. Dual polarisation is achieved by way of orthogonal linear polarisation obtained by excitation of the respective, mutually perpendicular electrical dipoles. These electrical dipoles are slanted 45° in opposite directions relative to the central longitudinal axis of the reflector.

Unfortunately, such antennas provide limited far field pattern performance: the horizontal 3dB HPBW (for Half Power Beam Width) stability faces large variation (for instance 65°+/−6°), the cross-polarisation level (for example the cross-polar discrimination at +/−60° about 5 dB) is too high across passbands up to 25% (for example 806-960MHz or 1700-2200MHz).

Document US2006/0109193 discloses an antenna improving the 3 dB HPBW stabilisation. Moreover, this antenna also reduces the cross-polarisation level. This antenna comprises an array of dual polarized radiating elements mounted on a reflector structure for reflecting polarised radiofrequency signals. The reflector structure has a pyramidal or conical horn-like shape for each radiating element.

This antenna design significantly increases the manufacturing costs, since horn-like shapes require the design of specific moulds.

In order to reduce the cross-polarisation level, other designs include lateral elongated choke reflectors fixed on both sides of a reflector. These designs lead to complex and costly manufacturing processes.

SUMMARY OF THE INVENTION

There is thus a need for a simple antenna structure that provides good far field performance. It is therefore an object of the present invention to provide a dual polarised radiating element for a cellular base station antenna, comprising:

- a reflector surface for reflecting radiation energy,
- four radiating monopoles distributed around an aperture area, each radiating monopole comprising a footing protruding from said reflector surface and a flange located above the reflector surface and protruding from said footing radially towards the outside, the flanges from adjacent monopoles extending radially perpendicular to each other, wherein it further comprises:
- four element feeds, each capacitively coupled to a respective monopole and protruding radially therefrom within the aperture area;
- powering means connected to the element feeds.

The four element feeds comprise each a footing portion and a flange portion connected to the upper part of the respective footing portion and perpendicular thereto, wherein each footing portion is capacitively coupled to a respective monopole at the level of its footing, and each flange portion is protruding radially from respective radiating monopole within the aperture area.

According to another embodiment, a pair of opposite element feeds extends above the reflector surface between two opposite footings.

According to another embodiment, each element feed comprises a first end portion capacitively coupled to a radiating monopole and a second end portion is protruding radially from said radiating monopole.

According to another embodiment, said first end portions of the element feeds are capacitively coupled to respective footings.

According to another embodiment, the first end portion of an element feed is approximately perpendicular to its second end portion.

According to another embodiment, said powering means comprises:

- a power divider;
- a first connection line connecting the power divider to an element feed;
- a second connection line connecting the power divider to an opposite element feed and introducing a 180° phase relative to said first connection line.

According to another embodiment, said first and second connection lines have identical impedance amplitudes.

According to another embodiment, said flanges are comprised within a common plane surface.

According to another embodiment, said reflector surface is plane and said flanges are parallel to the reflector surface.

According to another embodiment, said flanges are tilted relative to said reflector surface.

According to another embodiment, each monopole further comprises at least one wing extending from a respective flange and being tilted relative to this flange.

According to another embodiment, said flanges have a rectangular shape.

According to another embodiment, said footings have a rectangular shape having the same length as said flanges.

According to another embodiment, said flanges are provided with through holes extending tangentially relative to said aperture area.

According to another embodiment, the radiating element further comprises sidewalls protruding from said reflector surface on the same side as the radiating monopoles, said radiating monopoles being located between said sidewalls.

According to another embodiment, the intersection between the reflector surface and the lateral sidewalls form parallel lines and wherein each pair of opposite element feeds extend according to a direction forming approximately 45° with said parallel lines.

According to another embodiment, one pair of element feeds partly covers the other pair of element feeds.

BRIEF DESCRIPTION OF THE DRAWINGS

The advantage of the present invention will become apparent from the following description of several embodiments with reference to the accompanying drawings, in which.

DETAILED DESCRIPTION OF THE PREFERRED EMBODIMENTS

Figure 1:
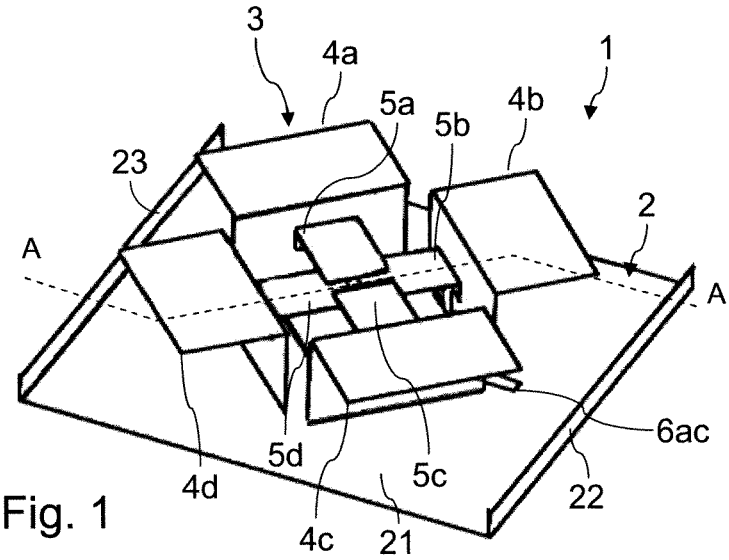
FIG. 1 is a perspective view of a radiating element according to a first embodiment of the invention.
Figure 2:
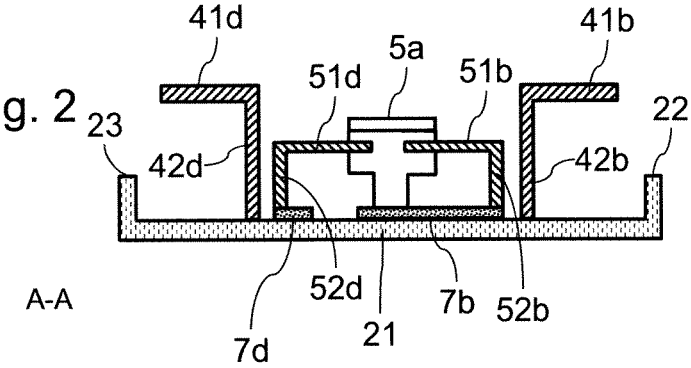
FIG. 2 is a section view of the radiating element of FIG. 1.

FIGS. 1 and 2 illustrate a dual polarised radiating element 1 for a cellular base station antenna. The radiating element 1 comprises a reflector 2 for reflecting radiation energy. The reflector 2 of this embodiment comprises a plane portion 21 forming a reflector surface.

A radiating portion 3 comprises four radiating electrical monopoles 4*a* to 4*d*. The monopoles 4*a* to 4*d* are distributed around an aperture area (illustrated by circle 8 at FIG. 3). Each monopole 4 comprises a footing 42 and a flange 41 formed by respective wall portions. Each monopole 4*a* to 4*d* can be formed out of a bended metal sheet. Each flange 41*a* to 41*d* is located above the plane portion 21. Each flange 41 is protruding from a respective footing 42 in a radial direction towards the outside. The radial direction is defined starting from the centre of the aperture area 8. In order to generate the dual polarisation, two flanges 41 from adjacent monopoles 4 extend radially perpendicularly to each other.

The radiating portion 3 also comprises four element feeds 5*a* to 5*d*. Each element feed 5*a* to 5*d* is capacitively coupled to a respective monopole 4*a* to 4*d*. Each element feed 5*a* to 5*d* is protruding from its respective monopole within the aperture area. An electric field is generated in the aperture area 8, forming a magnetic source. The combination of a magnetic source and of the electrical monopoles improves the 3 dB HPBW stability. The radiating portion 3 further comprises powering means connected to the feeds 5*a* to 5*d* and for which further details are provided below.

According to radiofrequency simulations and to measurements, a radiating element according to the invention provides at least the same far field pattern performance (say horizontal 3 dB HPBW stability, cross-polar discrimination, front to back ratio) across passbands up to 25% (for example 806-960MHz or 1700-2200MHz) as known radiating elements. Simulations and measurements led on the embodiment illustrated at FIGS. 1 and 2 provided the following results for the far field pattern:

a 3 dB HPBW stability of 65°+/−3 dB in passbands of 25%;

10 dB for cross-polar discrimination;

30 dB front to back ratio.

Moreover, these results were obtained with a radiating portion having a 54 mm height, which guarantees a low profile and a limited weight.

A radiating element according to the invention further has a simple structure whose manufacturing cost is particularly low. Such a radiating element 1 can be used in antennas equipping mobile phone networks.

Each element feed 5*a* to 5*d* comprises a footing portion 52*a* to 52*d* and a flange portion 51*a* to 51*d* connected to the upper part of a respective footing portion. Each flange portion 51*a* to 51*d* is perpendicular to its respective footing portion 52*a* to 52*d*, the element feeds thus having a L-shape in cross section. Each flange portion 51*a* to 51*d* is thus protruding radially from a respective monopole 4*a* to 4*d* within the volume located under the aperture area 8. Flange portions 51*a* to 51*d* and corresponding flanges 41*a* to 41*d* are protruding in a same direction but on opposite sides. Each footing portion 52*a* to 52*d* is capacitively coupled to its respective radiating monopole 4*a* to 4*d* at the level of its footing 42*a* to 42*d*.

Each pair of element feeds 5*a*,5*c* or 5*b*,5*d* extends above the plane portion 21 between two opposite footings, respectively footings 42*a*, 42*c* and 42*b*, 42*d*. One pair of flange portions is located higher above the plane portion 21 than the other: flange portions 51*a* and 51*c* partly cover flange portions 51*b* and 51*d*. The opposite flange portions, say 51*a*,51*c* and 51*b*, 51*d* are separated by an air gap at the centre of the aperture area 8. Each element feed 5*a* to 5*d* can be formed out of a bended metal sheet.

In this embodiment, the flanges 41*a* to 41*d* have a rectangular shape. The footings 42*a* to 42*d* also have a rectangular shape. These flanges 41*a* to 41*d* have the same length as their respective footings 42*a* to 42*d*. The flanges 41*a* to 41*d* of this embodiment are parallel to the plane portion 21. These flanges 41*a* to 41*d* are comprised within a common plane surface. The footings 42*a* to 42*d* are perpendicular to the plane portion 21 and to their respective flanges 41*a* to 41*d* (the monopoles 4*a* to 4*d* thus having a L-shape in cross section).

Figure 3:
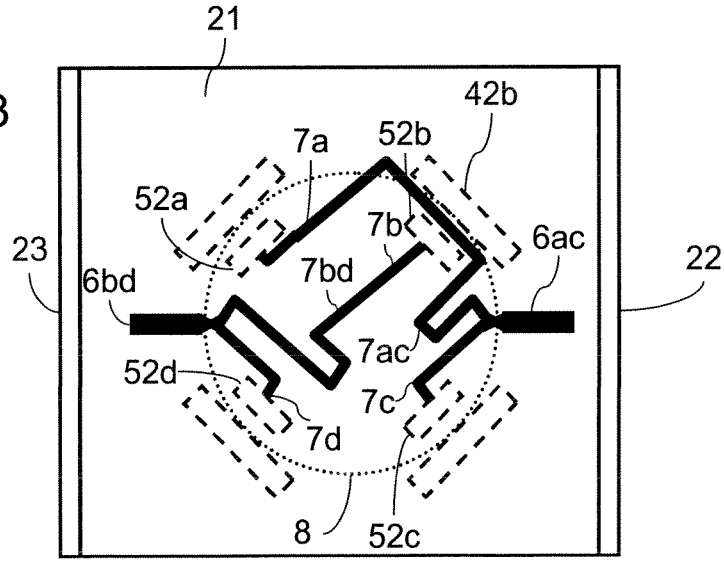
FIG. 3 is a top view of the electrical connections made on a reflector of the radiating element of FIG. 1.

In the embodiment illustrated at FIGS. 1 to 3, the reflector 2 further comprises sidewalls 22 and 23. The sidewalls 22 and 23 may be formed simply by bending the plane surface 21. The monopoles 4*a* to 4*d* and the feeds 5*a* to 5*d* are located between these sidewalls 22 and 23. The sidewall 22 is parallel to the sidewall 23. The sidewalls 22 and 23 are perpendicular to the plane surface 21. The intersections between the sidewalls 22 and 23 and the plane surface 21 form parallel lines. Each pair of feeds 5 extending in a direction forming approximately a 45° angle with these parallel lines.

FIG. 3 is a top view of electrical connections made on the plane surface 21. For each pair of feeds, powering means include a power divider, a first connection line between the power divider and the first feed, and a second connection line between the power divider and the second feed. For instance, the power divider 6*ac* comprises a three port junction connected to a connection line 7*a*, to another connection line 7*c* and to an entry line (not illustrated). The power divider 6*bd* comprises a three port junction connected to a connection line 7*b*, to another connection line 7*d* and to an entry line (not illustrated).

The connection line 7*c* connects the power divider 6*ac* to the lower end of the footing portion 52*c*. The connection line 7*a* connects the power divider 6*ac* to the lower end of the footing portion 52*a*.

The connection line 7*d* connects the power divider 6*bd* to the lower end of the footing portion 52*d*. The connection line 7*b* connects the power divider 6*bd* to the lower end of the footing portion 52*b*.

The connection line 7*a* comprises a $\lambda/2$ connecting portion 7*ac*. This connecting portion 7*ac* introduces a 180° phase relative to the connection line 7*c*.

To equally split the power provided by the power divider 6*ac*, the impedance amplitudes Zout of the connection lines 7*a* and 7*c* are preferably equal. These impedance amplitudes Zout are preferably chosen such that Zout=2*Zin, Zin being the impedance amplitude of the entry line. The entry line will preferably have a Zin impedance amplitude equal to 50 Ω. To balance the amplitude at the input ports of the element feeds, the input power can also be unequally split using connection lines having different impedances. The length of the $\lambda/2$ connecting portion 7*ac* can be shortened or lengthened to compensate for squint of the far field pattern. Connection lines may be formed using the air microstrip line technology.

Figure 4:
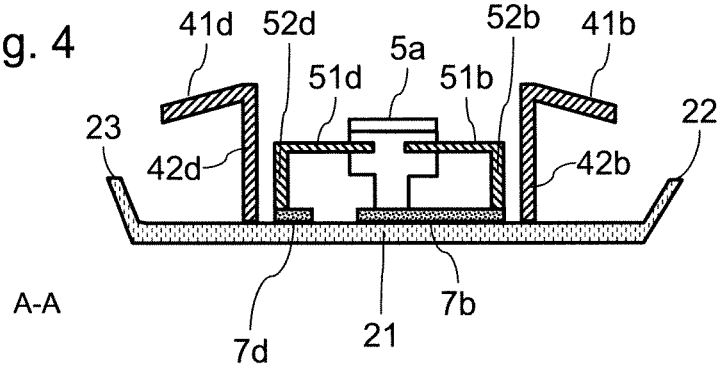
FIG. 4 is a section view of a second embodiment of a radiating element according to the invention.

In the embodiment illustrated at FIG. 4, the flanges 41*a* to 41*d* are tilted relative to the plane portion 21 of the reflector. The flanges 41*a* to 41*d* also form an angle with their respective footings 42*a* to 42*d* that differs from 90°. The angle formed between the sidewalls 22 and 23 and the plane surface 21 is higher than 90°.

Figure 5:
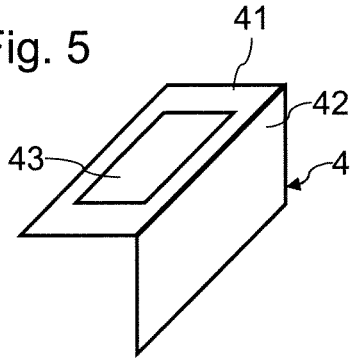
FIG. 5 is a perspective view of an alternative monopole shape.

FIG. 5 is a perspective view of another possible shape for flange 41. The flange 41 is provided with a through hole 43. This hole 43 is elongated in a direction that is tangent to the aperture area 8. This hole 43 has a rectangular shape. The radiating portion 3 using such a monopole 4 provides an improved front-to-back ratio.

Figure 6:
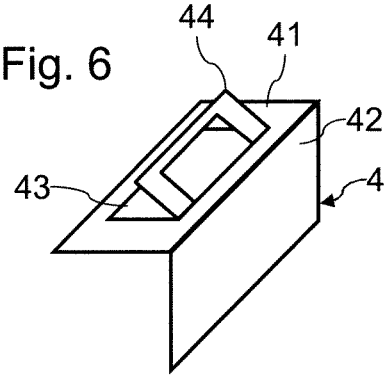
FIG. 6 is a perspective view of another alternative monopole shape.
Figure 7:
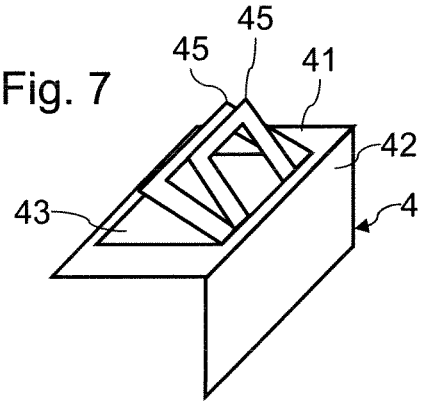
FIG. 7 is a perspective view of still another alternative monopole shape.

FIGS. 6 and 7 illustrate two alternative shapes for the monopoles 4. In these embodiments, each flange 41 is fitted with at least one wing protruding therefrom in the upper direction and being tilted relative to this flange 41. The radiating portion 3 using such a monopole 4 provides an increased impedance bandwidth. This design helps to adapt the impedance bandwidth performance (VSWR) of the radiating element 1 to the far field pattern bandwidth In the embodiment illustrated at FIG. 6, only one wing 44 is protruding from the flange 41. Both the flange 41 and the wing 44 have a rectangular shape with a through hole in their middle portion. The wing 44 is tilted relative to the surface of the flange 41.

In the embodiment illustrated at FIG. 7, two wings 44 and 45 are protruding from the flange 41. Wings 44 and 45 are tilted relative to the surface of the flange 41. The angle between both wings 44 and 45 and flange 41 are different. Both the flange 41 and the wings 44 and 45 have a rectangular shape with a through hole in their middle portion. Any other number of extending wings may be made on flange 41. The flange and the wings can be formed in a single metal piece by appropriate cuts and bendings.

By avoiding metal to metal contacts between the monopoles and the feeds, the risk of passive intermodulation (PIM) can be minimized, so that the PIM stability requirement of <−150 dBc with 2*43 dBm tones can be fulfilled.

The illustrated radiating element 1 only comprises a radiating portion 3 but radiating elements including several aligned radiating portions can also be made according to the invention.

The illustrated radiating monopoles 4 are independent parts but can also be made as a one-piece component.

The illustrated flange portions 51*a* to 51*d* are rectangular. However, other shapes can also be foreseen, notably a trapezoid shape.

There is claimed:

1. Dual polarised radiating element for a cellular base station antenna, comprising:

a reflector surface for reflecting radiation energy, four radiating monopoles distributed circumferentially around an aperture area prescribed by the inner perimeter of the four radiating monopoles and in which an electric field is generated that forms a magnetic source, each radiating monopole comprising a footing protruding from said reflector surface and a flange located above the reflector surface and protruding from said footing radially towards an outside, the flanges from adjacent monopoles extending radially perpendicular to each other, four element feeds comprising each a footing portion and a flange portion connected to an upper part of the footing portion and perpendicular thereto, where each footing portion is capacitively coupled to a respective radiating monopole at a level of its footing and each flange portion protruding radially from the respective radiating monopole within the aperture area, a power source connected to the four element feeds.

2. Dual polarised radiating element according to claim 1, wherein a pair of opposite element feeds extends above the reflector surface between two opposite footings.

3. Dual polarised radiating element according to claim 1, wherein said power source comprises:

a power divider, a first connection line connecting the power divider to an element feed, a second connection line connecting the power divider to an opposite element feed and introducing a 180° phase shift relative to said first connection line.

4. Dual polarised radiating element according to claim 3, wherein said first and second connection lines have identical impedance amplitudes.

5. Dual polarised radiating element according to claim 1, wherein said reflector surface is planar and wherein said flanges are comprised within a common plane surface, said flanges being parallel to the reflector surface.

6. Dual polarised radiating element according to claim 1, wherein said reflector surface is planar and wherein said flanges are tilted relative to said reflector surface.

7. Dual polarised radiating element according to claim 1, wherein each monopole further comprises at least one wing extending from a respective flange and being tilted relative to the respective flange.

8. Dual polarised radiating element according to claim 7, wherein said footings have a rectangular shape having the same length as said flanges.

9. Dual polarised radiating element according to claim 1, wherein said flanges are provided with through holes extending tangentially relative to said aperture area.

10. Dual polarised radiating element according to claim 1, further comprising sidewalls protruding from said reflector surface on the same side as the radiating monopoles, said radiating monopoles being located between said sidewalls.

11. Dual polarised radiating element according to claim 10, wherein the intersection between the reflector surface and the sidewalls form parallel lines and wherein each pair of opposite element feeds extend according to a direction forming approximately 45° with said parallel lines.

* * * * *